United States Patent [19]

De Bacci et al.

[11] 3,994,822

[45] Nov. 30, 1976

[54] PREPARATION FOR STORAGE OF FISSION PRODUCTS

[75] Inventors: Mario De Bacci, Brussels, Belgium; Michael Stuart Thomas Price, Weymouth, England

[73] Assignee: United Kingdom Atomic Energy Authority, London, England

[22] Filed: Jan. 29, 1975

[21] Appl. No.: 545,320

[30] Foreign Application Priority Data

Feb. 8, 1974 United Kingdom ..... 5955/74

[52] U.S. Cl. ..... 252/301.1 W; 264/.5; 427/6

[51] Int. Cl.[2] ..... G21F 9/34

[58] Field of Search ..... 252/301.1 W; 423/345; 264/.5; 427/6

[56] References Cited

UNITED STATES PATENTS

| | | | |
|---|---|---|---|
| 3,095,316 | 6/1963 | Hartwig | 423/345 |
| 3,736,169 | 5/1973 | Graham et al. | 264/.5 |

FOREIGN PATENTS OR APPLICATIONS

| | | |
|---|---|---|
| 1,376,365 | 12/1974 | United Kingdom |

*Primary Examiner*—Benjamin R. Padgett
*Assistant Examiner*—Deborah L. Kyle
*Attorney, Agent, or Firm*—Larson, Taylor and Hinds

[57] ABSTRACT

A method of preparing waste fission products for storage comprising combining graphite powder and a carbonaceous binder into one component, mixing this component with alpha-silicon carbide, and sprinkling this mixture on to waste fission product particles as the particles are tumbled in the presence of a solvent to form a tacky "overcoating" around the particles.

The "overcoated" particles are warm pressed to form a "green" body, then the temperature is raised to carbonize the binder. The body is then heated at an elevated temperature in contact with silicon so as to melt the silicon and impregnate the body, to form a matrix of beta-silicon carbide enclosing the waste fission product particles by reaction-sintering.

6 Claims, No Drawings

PREPARATION FOR STORAGE OF FISSION PRODUCTS

BACKGROUND TO THE INVENTION

This invention relates to the preparation for storage of fission products.

The safe storage of waste fission products presents a problem as the waste in many cases has to be stored over hundreds of years until its radioactivity falls to a level where it is no longer dangerous.

One solution to the problem, adopted at present, is to store the waste fission products in the form of liquids, and these liquids are stored in suitable containers or tanks where the fission products decay. Though the storage tanks may last for many decades depending on the materials of construction used to resist chemical attack, storage in liquid form does present problems in that the storage space required is large and the storage tanks have to be regularly inspected and eventually renewed.

Another solution to the problem which has been proposed is to form the waste fission products into glass bricks. This considerably reduces the required storage space, but the glass bricks would need to be enclosed in, for example, stainless steel containers to prevent any chemical or mechanical attack on the bricks.

The potential hazards that need to be considered when designing storage means for storing waste fission products include heat generated by the decay of the fission products or from some external source, mechanical damage to the storage means, chemical attack from the waste fission products and from an external source such as oxidation and corrosion, and diffusion of the waste fission products through the storage means. The waste fission products should also be in a convenient physical form so as to ease their subsequent mechanical handling. It is an object of the invention to provide an alternative method of preparing waste fission products for storage having advantages over the two methods described above.

SUMMARY OF THE INVENTION

According to the present invention, a method of preparing waste fission products for storage comprises "overcoating" waste fission product particles with a mixture including alpha-silicon carbide, carbon, and a binder, consolidating the overcoated particles, and reaction-sintering the consolidated overcoated particles in contact with silicon to form a matrix of beta-silicon carbide enclosing the said waste particles.

The waste fission product particles may be formed from liquid waste fission products.

The reaction-sintering route of dispersing the waste fission product particles in self-bonded silicon carbide may use the process described in the article "The Fabrication and Properties of Self-Bonded Silicon Carbide Bodies" by C. M. Forrest et al., published in "Special Ceramics 5" (British Ceramics Research Association: 1972) at page 99.

An example of the overcoating process is described in our British patent specification No. 1376365.

DESCRIPTION OF THE PREFERRED EMBODIMENT

The invention will now be described by way of example only, and starting from liquid waste fission products as obtained after reprocessing of nuclear fuels or as stored in the form of liquid wastes. Particles of the size required, or agglomerates of particles to the desired size range are produced by evaporation and calcination of liquid waste fission products, for example by use of a rotary calciner operating at about 900° – 1000° C. The fission products may be self-agglomerating, or alternatively an organic or inorganic agglomerating agent may be added to the fission product solution. A sol-gel process could also be used to form substantially spherical particles which would then be calcined. The particles or agglomerates of particles may be of a size as low as 0.5 mm and extending to at least 2 mm diameter. The particles are then overcoated by applying to them a mixture of alpha-silicon carbide, graphite powder, and a carbonaceous thermosetting binder (such as furan or phenolic resin. A suitable binder is phenol-formaldehyde novolac such as Carborundum Resin CS217. Carborundum is a Registered Trade Mark). The graphite powder and binder are combined into one component by dissolving the Resin CS 217 in methylated spirits, powdered hexamine is then stirred in until dissolved. The solution is then added slowly to the graphite powder in a Z blade mixer at room temperature. After about an hour the mixture is stopped and the pasty solid transferred to trays and maintained at 30° C in a vacuum oven for 24 hours. The dried lumps are then passed through a hammer mill which reduces the lumps to powder of approximately the original particle size of the graphite powder. The Resin/graphite component is then mixed with alpha-silicon carbide.

The powder mixture which may comprise graphite powder and alpha-silicon carbide powder in the ratio of 1:2 by weight is sprinkled on to a batch of the particles as they are tumbled in a drum. Methylated spirits, which is a solvent for the Resin CS 217, is applied as the tumbling proceeds and this makes the Resin CS 217 sufficiently tacky for the graphite powder to adhere to the outer surfaces of the particles. The overcoated particles are then removed from the drum, the solvent being allowed to dry, and are then consolidated by warm-pressing (typically at 150° C) to thermoset the Resin CS 217 and to form green bodies. The bodies are loaded into a high temperature furnace and placed on top of a billet of silicon already present in the furnace. The furnace is evacuated and first raised to about 500° C to carbonise the Resin CS 217. The furnace temperature is next raised to about 1600° C to melt the silicon whereby the liquid silicon impregnates the bodies and the bodies are reaction-sintered.

The liquid silicon rises to react with the graphite in the bodies whereby the graphite is converted to $\beta$ SiC which forms a matrix bonding the original alpha grains and enclosing the particles formed from the liquid waste fission products. The reaction of the graphite with the silicon may be written:

$$C + Si \rightarrow \beta\ SiC$$

When the reaction is complete, the bodies are allowed to cool to room temperature.

It will be appreciated that the aforedescribed method is also applicable to instances where solid waste fission products are used as the starting material, the steps of forming particles from liquid waste fission products being omitted. Additional steps to reduce the size of the solid waste fission products, or to agglomerate the solid waste fission products, may be necessary but such steps will be familiar to those skilled in the art of handling nuclear materials.

In some applications of the invention, the waste fission product particles may first be coated with one or more sealing layers of material, such as pyrocarbon, before they are overcoated by the aforedescribed method. A method of applying such a sealing layer is disclosed.

The invention results in the waste fission product particles being retained in a very hard, damage-resisting matrix of self-bonded silicon carbide, which also has thermal conducting properties to assist in the removal of fission product heat from the waste fission product articles.

The waste fission product particles once enclosed in the matrix of silicon carbide may subsequently be stored on suitable sites, including for example concrete pressure vessels of disused nuclear reactors.

It will be appreciated that in the case of nuclear fuel particles having silicon carbide fission product retaining coatings, as used for example in High Temperature Gas-Cooled Reactors, the irradiated fuel particles, after they have been removed from the fuel element in which they have been irradiated, may simply be stored without going through a reprocessing stage to recover the valuable unused fissile material they contain, but naturally such storage wastes these valuable materials. The present invention on the other hand allows the irradiated fuel particles to be reprocessed so that it is only the waste fission products that are stored.

We claim:

1. A method of preparing waste fission products for storage comprising:

overcoating waste fission product particles by tumbling the particles and mixing therewith a powder mixture including alpha-silicon carbide, carbon and a carbonaceous thermosetting binder, while a solvent is applied to make the binder tacky;

consolidating the overcoated particles at a temperature to thermoset the binder and form a green body;

placing the green bodies in contact with silicon in a furnace;

and reaction-sintering the green body by heating said body, initially at a temperature to carbonize the binder, and then at a temperature to melt the silicon and thereby impregnate the body therewith and form in reaction with the carbon in said body a matrix of beta-silicon carbide enclosing said waste fission products.

2. A method as claimed in claim 1 wherein the waste fission product particles are formed from liquid waste fission products.

3. A method as claimed in claim 1, wherein the waste fission product particles are coated with one or more layers of pyrocarbon before they are overcoated.

4. A method of preparing waste fission products for storage comprising combining graphite powder and a carbonaceous thermosetting binder into one component, mixing the said component with alpha-silicon carbide, overcoating waste fission product particles by sprinkling the mixed component and alpha-silicon carbide on to the waste fission product particles as the said particles are tumbled in a tumbling means and a solvent for the binder is applied to the tumbled mixture so as to make the binder tacky and the graphite powder adhere to the particles, consolidating the overcoated particles by warm pressing at a relatively low temperature to form a body, raising the temperature of the body so as to carbonise the binder, and then heating the body to about 1600° C in contact with silicon so as to melt the silicon, whereby the silicon impregnates the body and forms a matrix of beta-silicon carbide enclosing the waste fission product particles by reaction-sintering.

5. A method as claimed in claim 4, wherein waste fission product particles are formed from liquid waste fission products by evaporation and calcination of liquid waste fission products, and agglomeration of the particles so formed to a size extending from 0.5 mm diameter to at least 2 mm diameter.

6. A method as claimed in claim 4, wherein the waste fission product particles are coated with one or more layers of pyrocarbon before they are overcoated.

* * * * *